US005551188A

United States Patent [19]

Davlantes

[11] Patent Number: 5,551,188

[45] Date of Patent: Sep. 3, 1996

[54] SECURITY KNOB ON PET DOOR PANEL

[76] Inventor: George N. Davlantes, 21457 Iglesia Dr., Woodland Hills, Calif. 91364

[21] Appl. No.: 383,955

[22] Filed: Feb. 6, 1995

[51] Int. Cl.[6] ..... E05D 15/48

[52] U.S. Cl. ..... 49/169; 70/371; 70/416; 70/455; 292/DIG. 27; 292/DIG. 46; 292/132; 292/232

[58] Field of Search ..... 49/169, 168, 170; 292/232, DIG. 46, 132, 234, 98, DIG. 27; 70/416, 417, 221–224, 370, 371, 455, 450, 423, 424

[56] References Cited

U.S. PATENT DOCUMENTS

| | | | |
|---|---|---|---|
| 1,991,822 | 2/1935 | Snipes | 70/91 |
| 2,529,230 | 11/1950 | Smith et al. | 70/149 |
| 2,786,706 | 3/1957 | Wright | 292/336.3 |
| 2,788,996 | 4/1957 | Shoalts | 292/336.3 |
| 2,805,094 | 9/1957 | Stoakes | 292/336.3 |
| 2,852,294 | 9/1958 | Schlage | 292/169 |
| 2,862,378 | 12/1958 | Harris | 70/95 |
| 3,549,184 | 12/1970 | Anderson | 292/195 |
| 3,563,068 | 2/1971 | Dushane, Jr. | 292/98 X |
| 3,811,224 | 5/1974 | Garrison | 49/168 |
| 3,965,707 | 6/1976 | Byars et al. | 70/416 X |
| 4,108,482 | 8/1978 | Dietrich et al. | 292/DIG. 27 |
| 4,118,962 | 10/1978 | Block et al. | 70/455 |
| 4,121,864 | 10/1978 | Kagoura | 292/202 |
| 4,408,416 | 10/1983 | Davlantes | 49/168 |
| 4,575,141 | 3/1986 | Burns | 292/336.3 |
| 4,763,497 | 8/1988 | Nakai | 70/95 |
| 4,813,723 | 3/1989 | Anderson et al. | 292/336.3 |
| 5,195,342 | 3/1993 | Werner | 70/455 X |

*Primary Examiner*—Philip C. Kannan
*Attorney, Agent, or Firm*—Lahive & Cockfield

[57] ABSTRACT

A security knob assembly for a panel including a pet door, mounted on the panel remotely from the pet door, the security knob assembly including a latch movable between lock and unlock positions, the latch being operated by rotation of a knob after the knob is pushed in axially from a disengaged to an engaged position. The knob has an array of pins that engage an array of holes when the knob is pushed in to operate the latch. The latch may also be operated by a key cylinder, and the mechanism provides a plug to plug up the opening to the mechanism when a key cylinder is absent.

5 Claims, 7 Drawing Sheets

SECURITY KNOB ON PET DOOR PANEL

This invention relates generally to pet door panels, and, more particularly, to a security knob on a pet door panel.

BACKGROUND OF THE INVENTION

When it is desired to use a pet door with a set of sliding doors, a common arrangement is to mount the pet door in a long panel (which may be height-adjustable), and then insert the long pet door panel at one end of the sliding door frame opening. The pet door panel is secured to the sliding door frame, and the abutting sliding door is latched to the pet door panel. Such an arrangement is illustrated in U.S. Pat. No. 4,408,416 to the applicant. Conventional latching arrangements for the sliding doors may be inadequate for security purposes when such an arrangement is adopted, however. If the latch for connecting the panel to the sliding door is too simple, a rod or stick manipulated by someone through the pet door might be able to operate it.

It is therefor an object of the invention to provide an adequate security knob on a pet door panel added to a sliding door arrangement.

SUMMARY OF THE INVENTION

The invention comprises an elongate panel incorporating a pet door, and, mounted on the elongate panel remotely from the pet door, a knob for operating a latch connecting a sliding door to the elongate panel, the knob arranged to operate the latch in response to pushing the knob before turning it.

In another aspect of the invention, a security knob comprises a latching mechanism for a door operated by a first rotatable element, a second rotatable element being coaxially arranged with said first rotatable element, said second rotatable element including a knob, one of said first and second rotatable elements having a plurality of holes, and the other having corresponding pins for engaging the holes. The first and second rotatable elements are biased apart, and are responsive to pressure on the knob to come closer together, with the pins engaging the holes, so that turning the knob operates the latch.

In still another aspect of the invention, a security knob includes rotatable elements for operating a latching mechanism for a door. The rotatable elements are located in a housing having an opening accessible from the exterior of the door for insertion of a key mechanism for operating the latching mechanism. A plug for closing the opening is insertable between the latching mechanism and the exterior for closing off the opening when no key mechanism is present.

DESCRIPTION OF THE DRAWINGS

Other objects, features and advantages of the invention will be described below, or will be apparent from the following detailed description of a preferred embodiment of the invention, including the drawings thereof, in which.

DETAILED DESCRIPTION OF PREFERRED EMBODIMENTS

Figure 1:
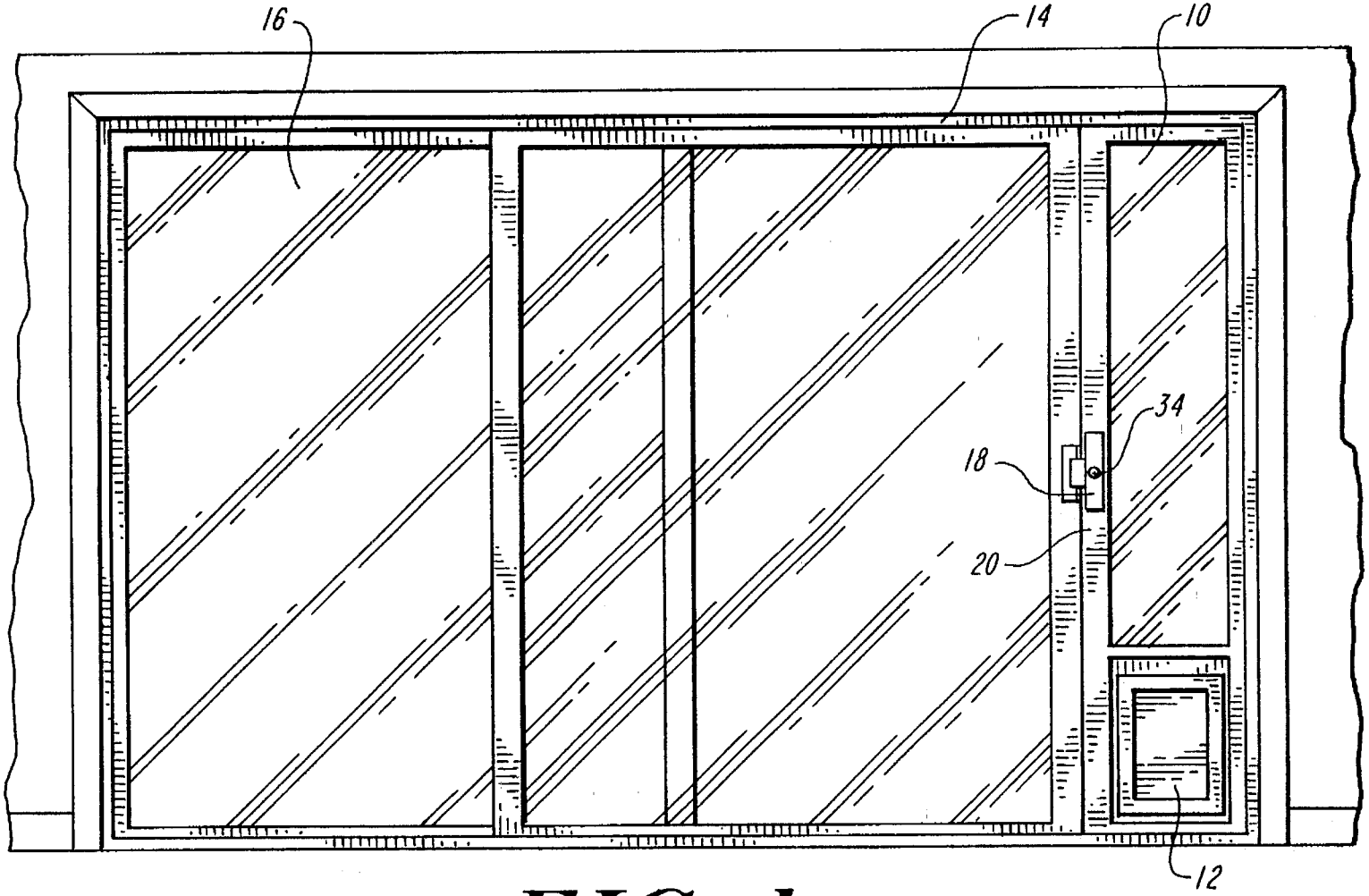
FIG. 1 shows a sliding door, with a pet door panel inserted into the frame, and the knob assembly of the invention.

As shown in FIG. 1, an elongate panel 10 including a pet door 12 for passage of a pet animal such as a dog or cat is secured in one end of a frame 14 for sliding doors 16 (generally of glass). The panel 10 is secured in the frame 14 by fasteners (not shown) so that the panel 10 is not removable from outside a building, typically a residence, served by the sliding doors 16.

Figure 1A:
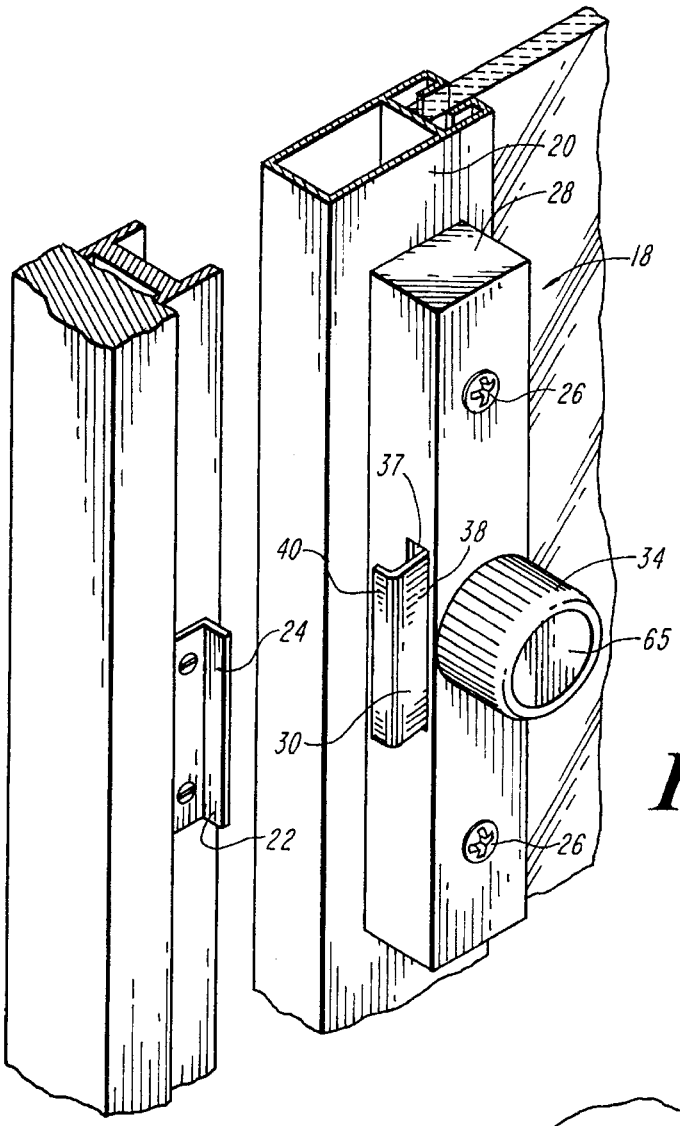
FIG. 1A is a perspective view of the knob assembly.

As shown in more detail in FIG. 1A, a security knob assembly 18 is mounted on a stile (frame member) 20 of the panel 10, on the inside. The assembly 18 is located remotely from the pet door 12. That is, the assembly 18 is located far enough from the pet door 12 so that an intruder could not put an arm through the pet door 12 and reach the knob assembly 18 to operate it by hand.

Figure 2:
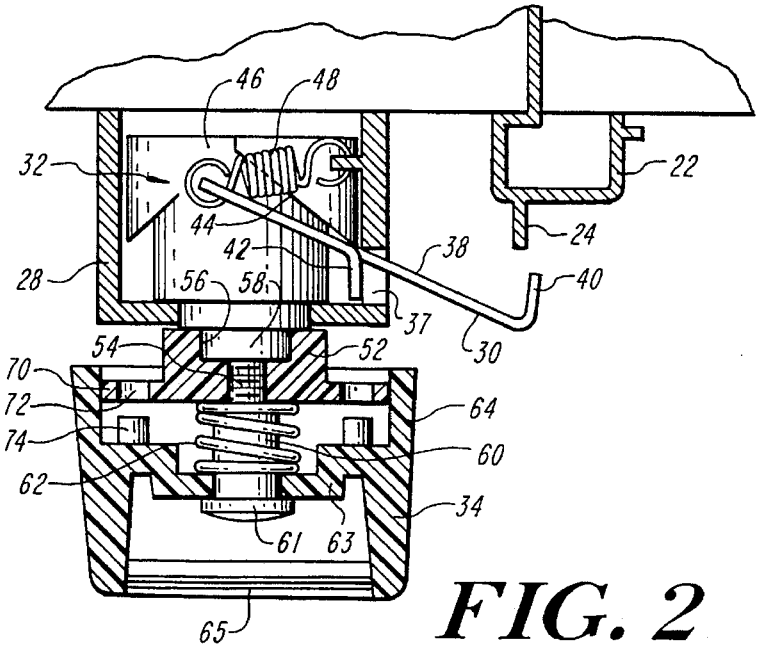
FIG. 2 is a sectional view of the latching mechanism open, and the security knob disengaged.
Figure 3:
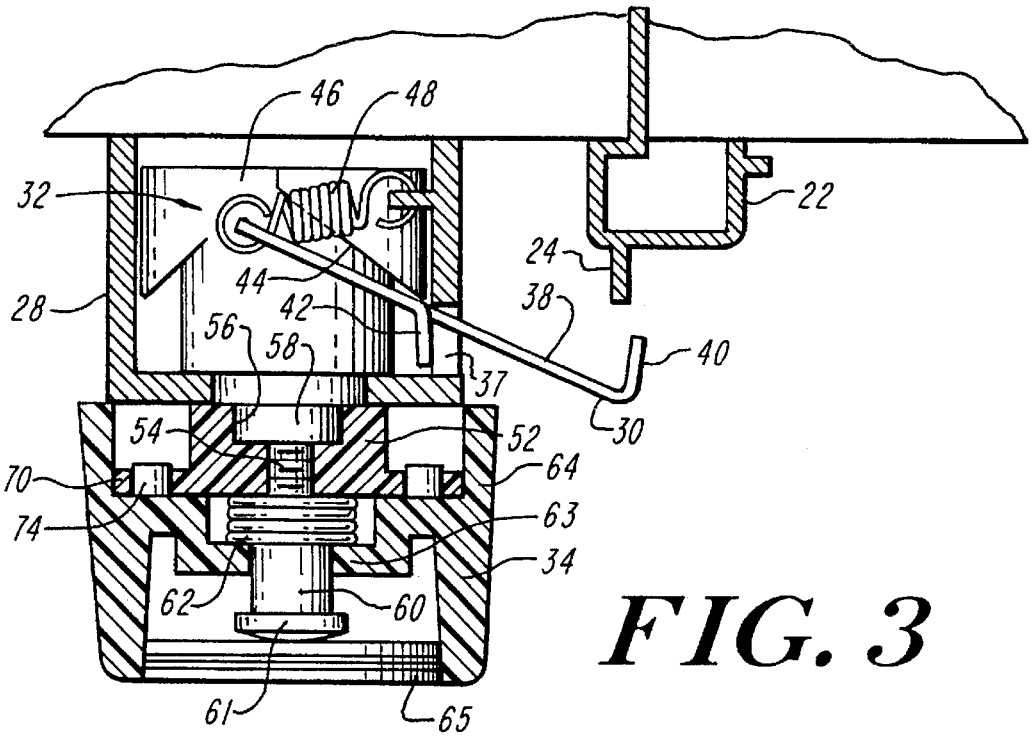
FIG. 3 is a sectional view like FIG. 2, except that the security knob is engaged.
Figure 4:
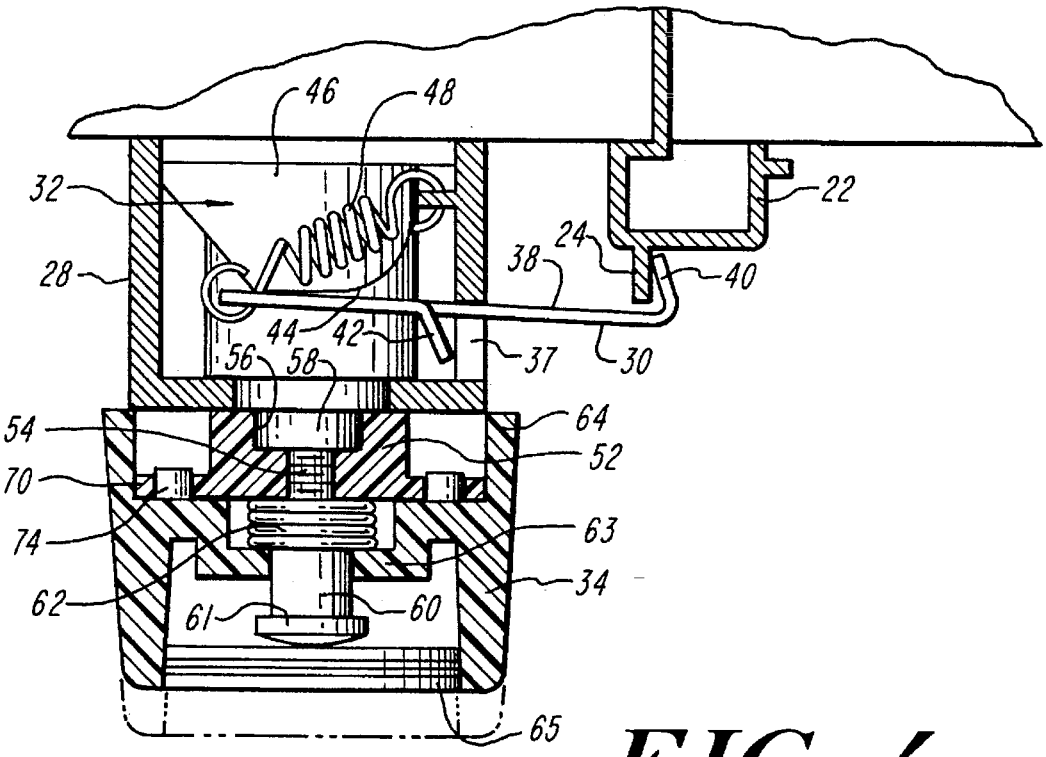
FIG. 4 is a sectional view like FIG. 3, except that the latching mechanism is closed.

As seen in FIGS. 2, 3, and 4, a metal lip assembly 22 is mounted on the sliding door 16 to provide a lip 24 that can be engaged by the security knob assembly 18. The lip assembly 22 is conventional, and any assembly that provides a feature that could be engaged by a movable latch could be substituted for it. In the assembly shown, the lip 24 is in the form of a rectangular wall extending inwardly from the assembly 22 secured in a conventional way (not shown) to the sliding door 16.

The security knob assembly 18 includes a base unit 28 that is mounted on the stile 20 with a pair of screws 26 (see FIG. 1A). The base unit 28 houses a latch 30 and the latch mechanism 32 for operating the latch 30. FIG. 2 shows the latch 30 disengaged from the lip 24. FIG. 3 shows the latch 30 disengaged from the lip 24 but with the knob 34 engaged with the latch mechanism 32. FIG. 4 shows the latch 30 in locked engagement with the door lip 24.

The latch 30 is a primarily flat metal piece 36, with a latch portion 38 that projects through a slot 37 in the side of the base unit 28. It terminates in an angle portion 40 that can engage the door lip 24. The end portions of the metal piece 36 within the base unit 28 have inside angle portions 42. The bottom surface of the metal piece 36 within the base unit 28 rides atop a camming surface 44 formed on a rotatable operating member 46.

Figure 5:
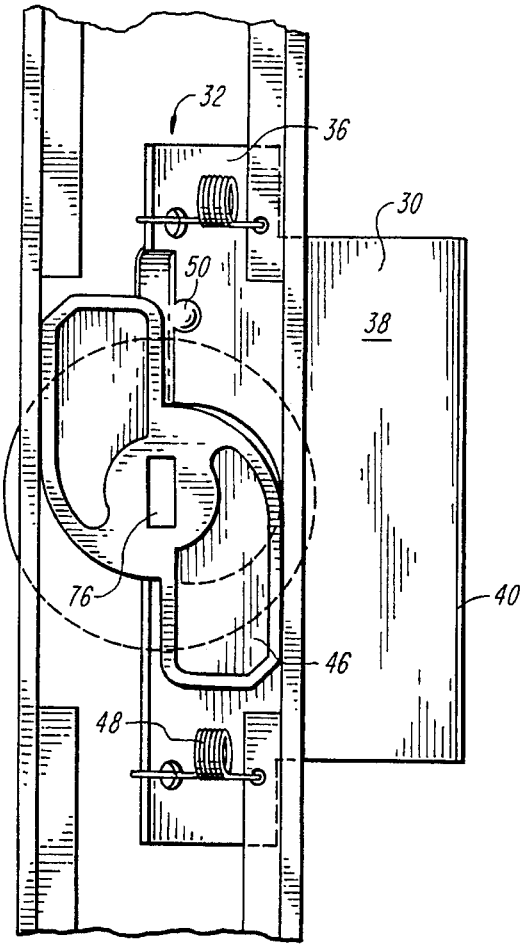
FIG. 5 is a bottom view of the latching mechanism of FIG. 3.

In one position of the operating member 46 (see FIGS. 3 and 5), the metal piece 36 and the camming surface 44 are arranged such that a pair of springs 48 connected between the edge of the metal piece 36 and the inside wall of the base unit 28 bias the latch 30 to the disengaged position.

Figure 6:
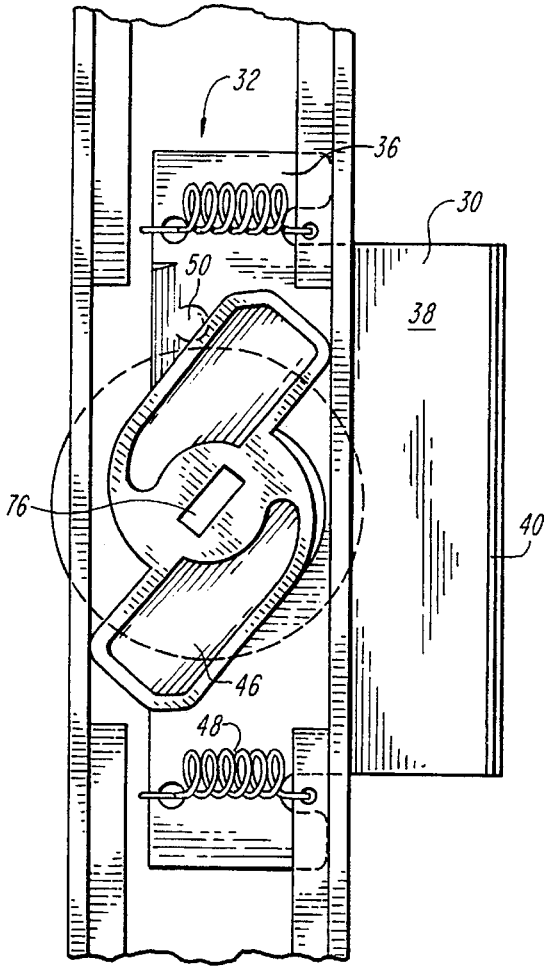
FIG. 6 is a bottom view of the latching mechanism of FIG. 4.
Figure 7:
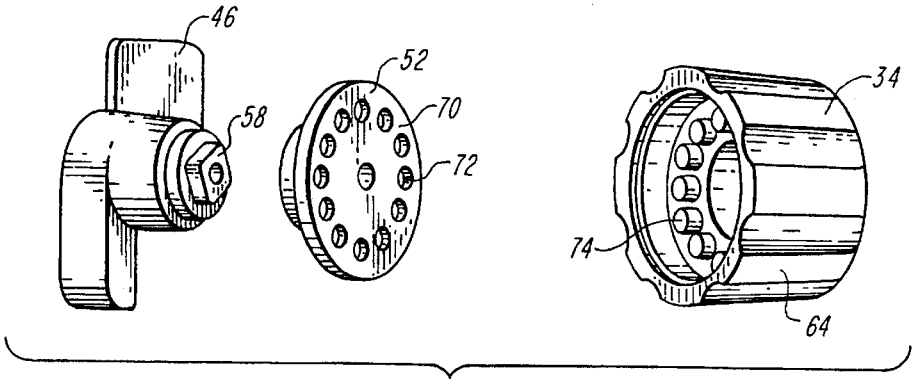
FIG. 7 is an exploded view of the elements of the security knob.

In the other position of the operating member 46 (see FIGS. 4 and 6), the camming surface 44 moves the metal piece 36 to a position in which the latch 30 is in a position in which it engages the door lip 24, preventing the door 16 from opening, in effect, locking it. The springs 48 are extended in this position, but a bump 50 on the metal piece 36 prevents movement of the metal piece 36 bearing the latch 30 back to the first position without the application of another force.

The force to move the operating member 46 is applied by the knob 34. A plastic clutch plate 52 is secured by a screw 54 to the operating member 46. The clutch plate 52 has a square hole 56 keyed to a square projection 58 on the operating member 46 to make the clutch plate 52 rotate with the operating member 46, when it is secured to it by the screw 54. The screw 54 also has a stud-like portion 60 that extends above the clutch plate 52, terminating in a head 61. The screw 54 also attaches the knob 34 to the assembly, the head 61 of the screw 54 capturing the knob 34 at a recessed wall 63 of the knob. An end plate 65 on the knob covers the recessed Wall 63 and the head 61 of the screw 54. The exterior wall 64 of the knob 34 generally covers the clutch plate 52. The interior of the assembly includes a co spring 62 surrounding the stud-like portion 60 of the screw 54 extending between the clutch plate 52 and the knob recessed wall 63.

The clutch plate 52 includes a peripheral flange portion 70 that has a number of holes 72 equally spaced around it. The interior of the knob 34 includes a corresponding number of pins 74 projecting toward the holes 72 of the clutch plate 52. The coil spring 62, housed between the knob 34 and the clutch plate 52, biases the pins 74 of the knob 34 away from the clutch plate 52 (see FIG. 2). As shown in FIG. 3, pushing t he knob 34 against the spring 62 allows the pins 74 to engage the holes 72. Turning the knob 34 then turns the operating member 46 to operate the latch 30.

Figure 8:
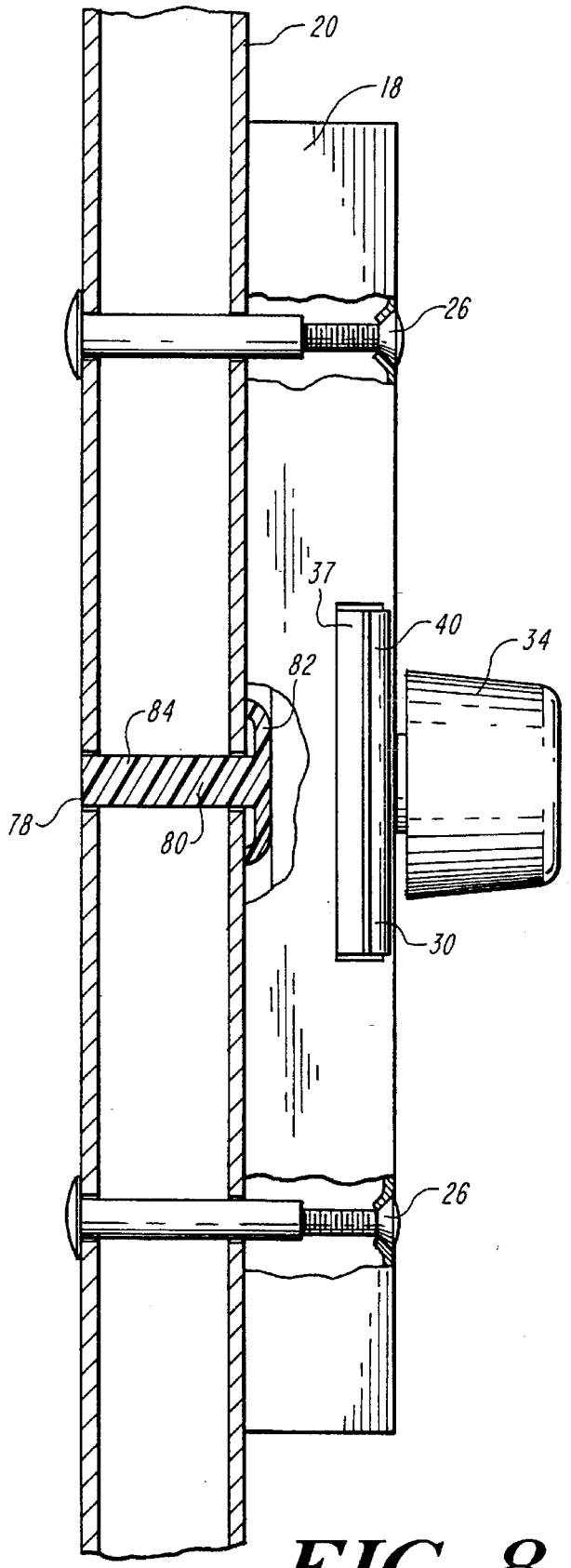
FIG. 8 is a sectional view of the assembly, showing a plug that blocks an access for a key cylinder.
Figure 9:
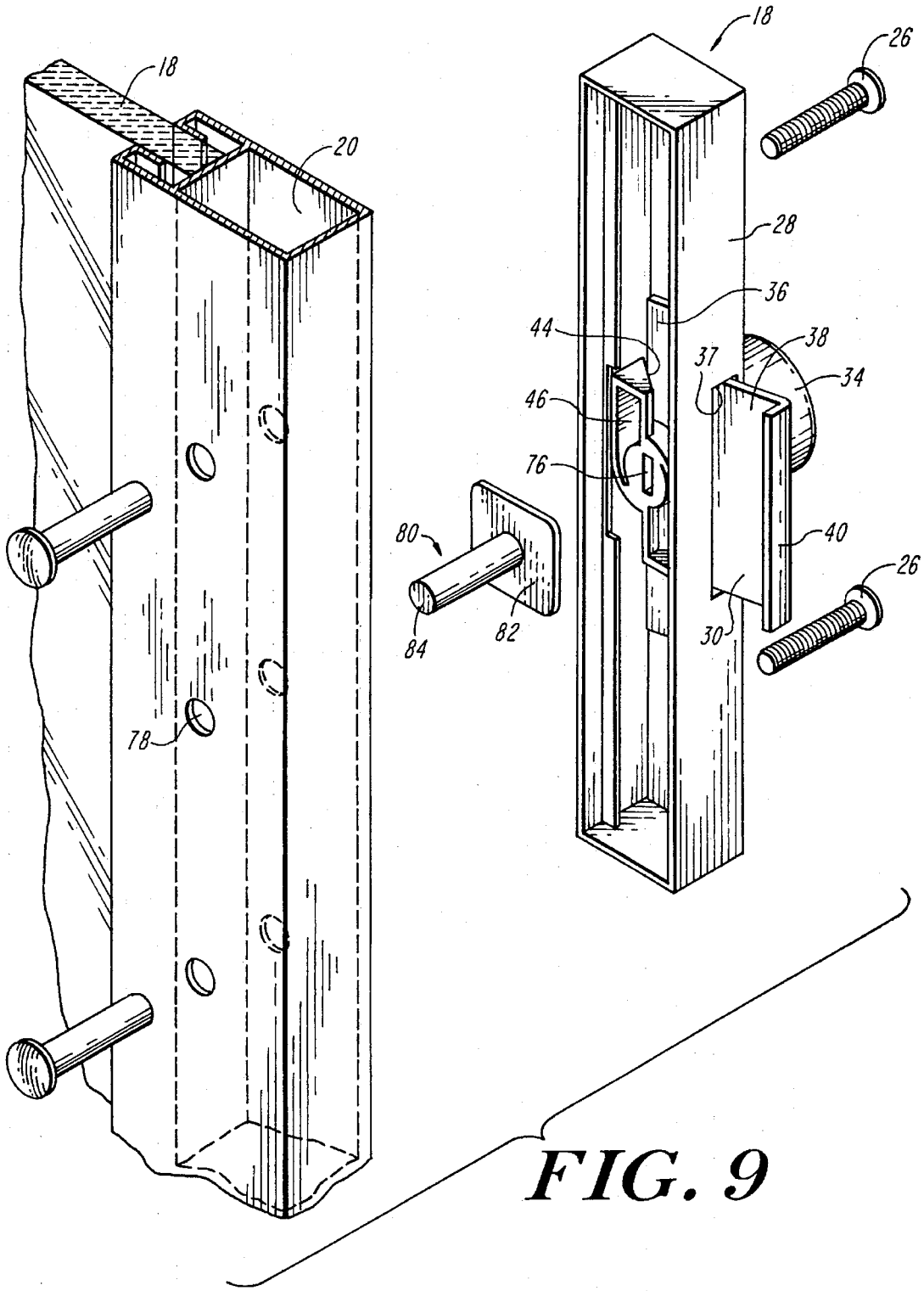
FIG. 9 is an exploded view of the assembly, showing the blocking plug.

The operating member 46 may also be turned by engaging a slot 76 on the side opposite the knob 34 (see FIGS. 8 and 9). The slot 76 could be engaged by a key cylinder extending through an access opening 78 in the stile 20 to which the security knob assembly 18 is secured. A key cylinder is not shown, but an access opening 78 through the stile 20 is. The security knob assembly 18 shown includes a plug 80 to close off the access opening 78 in the absence of a key cylinder. The plug 80 includes a head 82 captured in the base unit 28 between the bottom of the base unit 28 and the operating member, 46 and a shaft 84 extending to the end of the access opening 78, blocking access to the mechanism.

Figure 10:
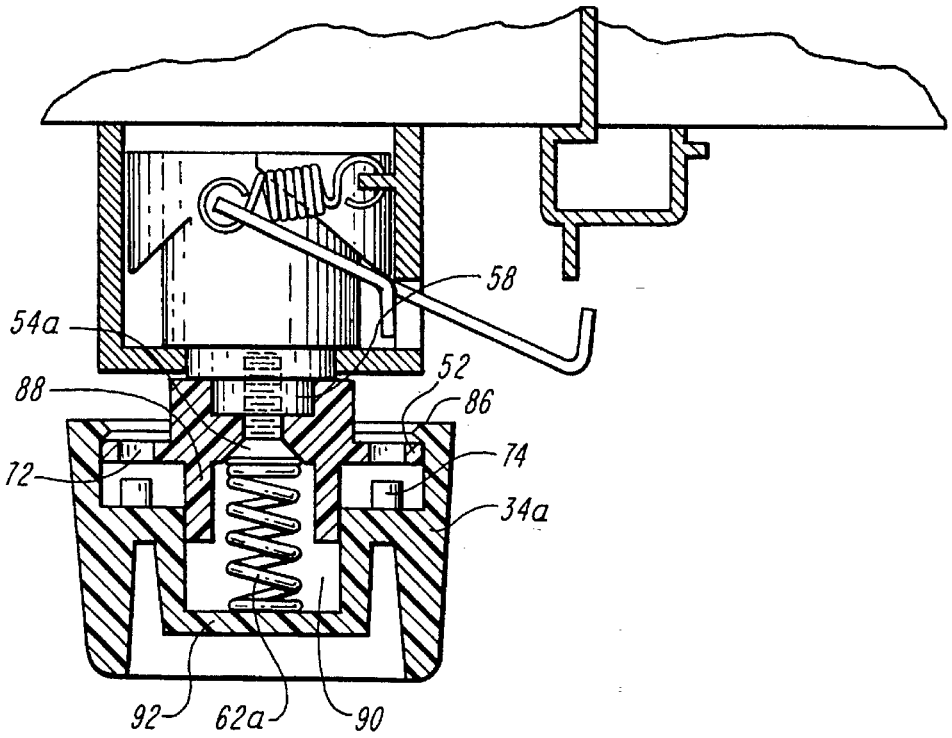
FIG. 10 is a sectional view of a second embodiment of the latching mechanism, similar to FIG. 2.
Figure 11:
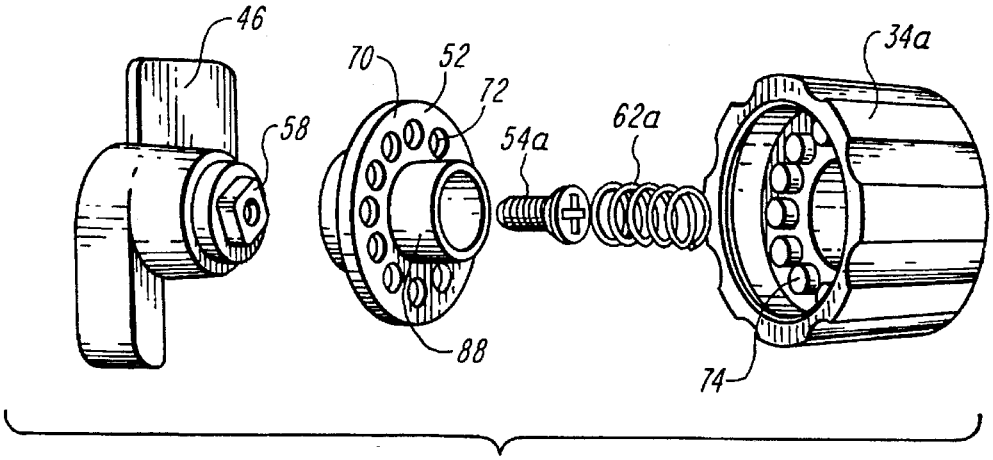
FIG. 11 is an exploded view of the second embodiment, similar to FIG. 7.

FIGS. 10 and 11 show a variation of the knob assembly. As shown in FIG. 10, the knob **34*a* of the second embodiment has a lip 86 that captures the clutch flange 70 of the clutch plate 52. The coil spring 62*a* that biases the knob assembly away from engagement is seated within a cylindrical wall 88 extending from the clutch plate 52. The cylindrical wall 88 fits within a recess 90 formed in the knob 34*a***.

The coil spring **62*a* extends from the head of a screw 54*a*, that secures the clutch plate 52, mounted on the square projection 58, to the pivoting operating member 46, to the inside knob cap 92. Otherwise, the knob 34*a* has the same arrangement of pins 74, corresponding to clutch plate holes 72 in the clutch flange 70**.

In operation, the knob **34*a* of the second embodiment acts similarly to the knob 34 of the first embodiment. That is, pressing down on the knob 34*a* engages the pins 74 in the holes 70 of the clutch plate 52, so that the clutch plate 52 can turn and operate the latch 30. Releasing the knob 34*a* causes the spring 62*a* to act to separate the pins 74 from the holes 70**.

The description given above is a description of illustrative embodiments of the invention, and additions, alterations and modifications of the illustrative embodiments are within the abilities of those skilled in the art. The scope of the invention is not limited to the embodiments but is instead defined by the following claims.

I claim:

1. An elongate panel securable in one end of a sliding door frame, including a pet door for passage of a pet, and latch means mounted on said panel remotely from said pet door, for latching a sliding door slidable in said sliding door frame, including a latch movable between a lock position in which it lockingly engages said sliding door, and an unlock position in which it does not lockingly engage said sliding door, and operating means for moving said latch between said lock and unlock positions, including a rotatable knob, said knob being movable along its axis of rotation between first and second positions, said operating means being responsive to rotation of said knob to move said latch when said knob in its said first position, and not responsive when said knob is in its said second position, said operating means including biasing means for biasing said knob toward said second position.

2. An elongate panel of claim 1, in which said operating means and said knob have first and second opposing plate elements, a first of said opposing plate elements having at least one projecting pin, and a second of said opposing plate elements having at least one hole corresponding to said pin, said pin engaging said hole when said knob is in its said first position, and not engaging said hole when said knob is in its second position.

3. An elongate panel of claim 1, in which said latch means defines an access opening for insertion of a key cylinder to operate said latch by a key, and includes a plug means for plugging said access opening whereby said access opening is closed when a key cylinder is not present in said latch means.

4. An elongate panel of claim 3, wherein latch means includes means for securing said plug means in said latch means.

5. An elongate panel securable in one end of a sliding door frame, including a pet door for passage of a pet, and latch means mounted on said panel remotely from said pet door, for latching a sliding door slidable in said sliding door frame, and operating means for moving said latch between latch and unlatch positions, said latch means defining an access opening for insertion of a key cylinder to operate said operating means by a key, including removable plug means for plugging said access opening, whereby said access opening is closed when a key cylinder is not present in said latch means.

* * * * *